United States Patent [19]

Adams

[11] Patent Number: 4,560,081

[45] Date of Patent: Dec. 24, 1985

[54] EASILY RELEASABLE AND SEALABLE SANITARY LID-SPOUT

[76] Inventor: Jay J. Adams, 133 Scott Rd., Pittsburgh, Pa. 15239

[21] Appl. No.: 698,896

[22] Filed: Feb. 6, 1985

[51] Int. Cl.[4] ..... B65D 51/20

[52] U.S. Cl. ..... 220/257; 220/260; 220/85 SP; 220/306; 222/529; 222/530

[58] Field of Search ..... 220/256, 257, 260, 306, 220/339, 90.4, 85 SP; 222/527, 528, 529, .530

[56] References Cited

U.S. PATENT DOCUMENTS 4,073,413 2/1978 Tabher et al. ..... 222/529
4,153,172 5/1979 Bialobrzeski ..... 220/85 SP
4,294,382 10/1981 Sommers et al. ..... 222/529
4,403,709 9/1983 Meins et al. ..... 220/85 SP
4,422,563 12/1983 Babiol ..... 220/85 SP

*Primary Examiner*—George T. Hall

*Attorney, Agent, or Firm*—Parmelee, Miller, Welsh & Kratz

[57] ABSTRACT

A beverage can lid spout unit is provided with a closing lid movable between open and closed positions over a peripheral mounting part. A bellows part is secured within the mounting part and is biased to move outwardly when the lid is moved to an open position. When the lid is moved to a closed position, it compresses the bellows within confines of the mounting part to close-off the spout.

17 Claims, 8 Drawing Figures

EASILY RELEASABLE AND SEALABLE SANITARY LID-SPOUT

This invention pertains to a new and improved lid or cap unit for soft drink or beverage cans which is tamperproof prior to sale and which upon sale can be easily opened by the user and after opening has a collapsible dispensing spout. It has the characteristic of providing a fully sealing relation as to the opening therein that can be resealed when the user only desires to dring a portion of the liquid and to save the remaining liquid for further use.

There has been a problem in this particular art from the standpoint of so-called metal lift and pull tabs, in that they are hard to operate, frequently break and require a key, knife blade or strong fingernail to open. Further, they are wasteful of the contents of a can, in that often, the user only wishes to drink a portion of the contents and to save the remainder. If an attempt is made to save the remainder, the can may be tilted or knocked over and further, the liquid contents are not protected from contaminating elements. Also, to directly drink the contents, it is necessary to apply the mouth over the opening left in the can by tearing back the metal tab. This is unsanitary to say the least.

Attempts have been made to provide a pull tab can opening with a nipple-like mouthpiece whose closed end is to be torn off with the metal tab or is to be slit to enable drinking of the contents, see U.S. Pat. No. 4,403,709. Also, overlaid plastic end covers have been provided having a nipple that is held in a compressed, folded in or over relation until released by removal of an adhesive strip, see U.S. Pat. No. 4,415,097. However, both of these references contemplate the use of a conventional metal pull tab for opening the can and the employment of an auxiliary plastic cap for providing a drinking nipple. They result in an expensive appendage that is not justified from a cost standpoint and do not meet the problem involved.

An object of the invention has been to devise an inexpensive, practical resin or plastic unit that will replace the conventional metal pull tab in the top end of a soft drink or beverage can and that will meet the problem above outlined.

Another object of the invention has been to provide a new and improved form of can lid closure.

Another object has been to devise a factory mounted closure for a can that will take the place of a conventional metal pull tab, and that can be easily opened and closed by the user so as to maintain the contents in a sealed relation at all times other than when they are being consumed.

A further object of the invention has been to provide a fool-proof type of lid-spout that will enable the full contents of a can to be used and dispensed at different times without loss, contamination or spillage.

A still further object has been to devise a beverage can, having a unitary opening, dispensing and closing lid construction in which stacking of the cans will be facilitated.

These and other objects of the invention will appear to those skilled in the art from the illustrated embodiments and the claims.

Figure 3:
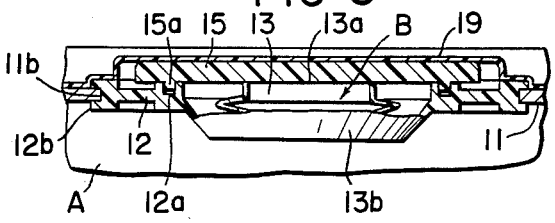
FIG. 3 is a partial side section on the scale of FIG. 2, particularly showing details of the lid-spout unit of the invention.
Figure 2:
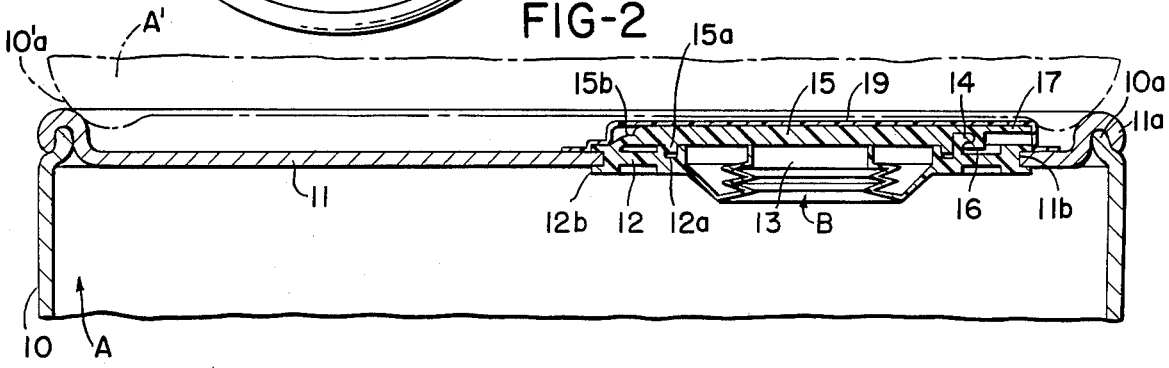
FIG. 2 is an enlarged side sectional view in elevation showing details of the can of FIG. 1; in its construction the top lid is provided with a collapsible spout that is easily opened and closed. This figure also illustrates the endwise stackability of cans employing a lid constructed in accordance with the invention.
Figure 5:
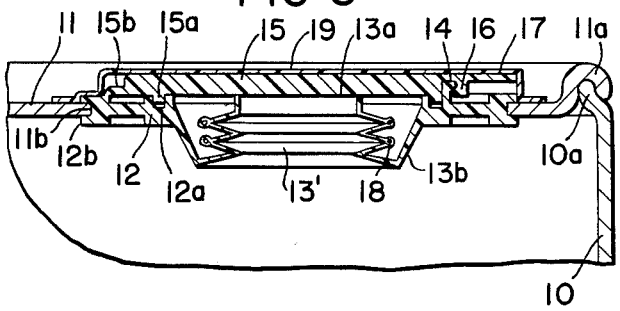
FIG. 5 is a side section in elevation on the scale of FIG. 2 illustrating a modified construction of the invention in which a wire spring is embedded in convolutions of bellows portions of the spout.
Figure 8:
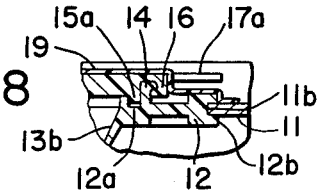

And, FIG. 8 is a side fragmental section of a slight modification in which the lid tab extends in a sealed relation through the initial sealing-over cover sheet of FIGS. 2, 3 and 5.

Referring to the drawings, a beverage or soft drink dispensing container or can A is shown provided with an enclosing, curvilinear or circular upright side wall 10 having an upper lip edge or rim portion 10*a* that is turned inwardly and upwardly and has a sealed-off fitted engagement within a curled-over outer edge 11*a* of a top end or closure lid wall 11 of the can. As indicated in FIG. 2, the lip edge 10*a* is secured within the curled-over outer edge 11*a* in such a manner that the outer edge falls within the outer boundary of the side wall 10. This is conducive to side-by-side storage or shipping stacking of the cans. Also, as shown in FIG. 2, the convex upwardly hump of the edge 11*a* provides an annular projection or bounding ridge that is adapted to receive a continuous annular ridge portion 10'*a* on the bottom wall of an upper can A'; this facilitates aligned, vertical stacking of the cans.

A lid spout unit B of the invention is shown in FIGS. 1, 2, 3 and 4 as having an outer, rim-like, supporting and container-mounting, main body part 12 which, at its outer periphery 12*b*, is grooved or bifurcated to tightly fit over and is sealed or cemented on an edge 11*b* of a pour opening 11*b* in the lid 11. The outer body part 12 also has an upwardly open, sealing groove, slot or bifurcated portion 12*a* which serves as a continuous, receiving and sealing seat portion for a continuous, downwardly projecting, sealing ring or tongue portion 15*a* of an integral, hinged lid part 15. It will be noted that the tongue 15*a* is an integral portion of the lid 15, and that the lid is flexibly-integrally hinged by a connecting hinge portion 15*b* to the outer body part 12 for movement between a closed, tight, resiliently sealing position of FIGS. 2 and 3 and an upwardly, outwardly open position of FIG. 4. As shown in FIG. 5, the lid 15 has a planar underside that is adapted to provide a sealing-off abutment with an upper lip edge 13*a* of an outer, open end of a drinking or pouring spout or nozzle 13. At the same time, the ring portion 15*a* is in a sealing-off engagement within the slot 12*a* of the body 12 to thus enable a dual sealing-off action with respect to the liquid contents of the can.

A front end of the mounting body part 12 of the unit B has a resilient hook-like element or snap 14 which is adapted to cooperate with a resilient hook-like element or snap 16 that projects from the underside of the lid 15 to normally retain the lid in a latched, fluid sealing-off, closed position and also, to press and collapse bellows-like, central portion of the spout 13 inwardly a short distance within the container 10. The nozzle 13 is connected at its inner open end by a cone-shaped portion **13*b* to the inner area of the mounting body part 12**. The unit B, as an optimum, will be constructed of a natural or synthetic resilient flexible material, such as of a natural or synthetic rubber, plastic or resin. The lid spout unit B may, however, be constructed of a suitable, somewhat flexible metal material and provided with gasketed sealing surfaces.

Figure 4:
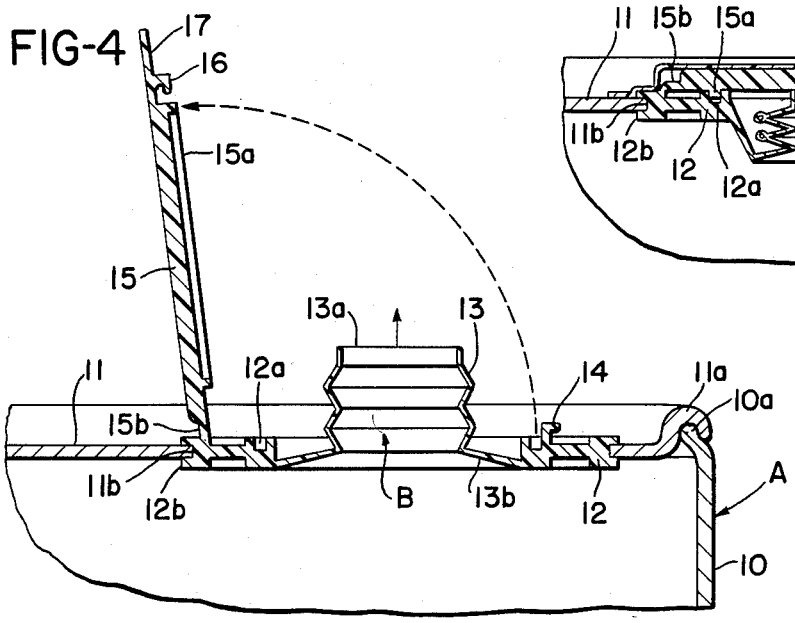
FIG. 4 is a side section in elevation of the lid-spout of FIGS. 1, 2 and 3 showing it in its open, dispensing position in which an initial sealing-off cover sheet is omitted or has been removed, the lid has been raised and the spout has been permitted to expand outwardly.

The spout 13 is shown of bellows-like, inwardly foldable construction such that it will be normally biased or tensioned to expand from the inwardly folded, compressed position of FIGS. 2 and 3 to an outer, usable, pouring or drinking position of FIG. 4. The heighth of the spout 13 is preferably only sufficient to provide a suitable mouth engagement therewith by a person desiring to drink the contents of the can. This will also minimize the amount of space taken up by it when in its inwardly compressed, closed-off position. The construction thus illustrated enables a purchaser of a filled container to drink or dispense any amount of liquid that he or she desires; any remaining contents of the can may be safely and in a sanitary manner retained for later use without danger of spillage or loss.

The present construction eliminates the conventional metal pull tab and the difficulties which have heretofore been encountered in connection therewith, both from the standpoint of obtaining a suitable grip on the tab to tear an opening in the can lid, and from the standpoint that the user has to place his or her mouth over the opening to directly drink its contents, thus subjecting the lips and tongue to the possibility of cutting action of its metal edges. Further, as will be apparent, there is no satisfactory way of saving any remaining contents of the can or container, since the tear-off tab, whether it has been pulled back to provide a tear opening or has dropped into the can through such opening, will not thereafter serve to provide a sealing-off of the can's contents.

It will be noted that the unit B, as above described, also has a lid release tab 17 projecting in a substantially opposite relation with respect to the connecting hinge portion **15*b*. A further advantage of the present construction is that it is fully sanitary, in that the mouth is only applied to a spout portion 13, that is covered-over and hidden when the lid 15 is closed. The entire spout assembly when the can has been filled and is to be then stored and shipped, may be initially provided with a tamperproof, protective, film-like cover, such as now considered necessary for over-the-counter drugs. That is, as shown in FIGS. 2 and 3, a thin, film-like protective, tear-off, clear plastic sheet 19 is employed in such a manner as to completely enclose and seal-off the unit B. It has to be cut, pulled or torn-off before entry can be obtained to the lid spout unit B. This not only protects the unit B, but prevents tampering as to the contents of the can prior to actual usage. The thin film 19 projects, as shown, completely over and about the unit B and at its outer edges is cemented or heat-sealed to the top of the lid 11** of the can.

Figure 6:
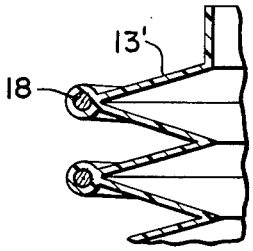
FIG. 6 is an enlarged fragmental side section of the bellow-spout construction shown in FIG. 5.

A slightly modified construction is shown in FIGS. 5 and 6. In this construction, the spout 13' is provided with an imbedded spring 18 along its convolutions. This spring may be of metal construction or any other suitable material and is shown in FIG. 6 as fully closed-off and sealed within the convolutions of the spout part 13'. This construction may be used when the material for the convolutions of the spout 13 is of a type that does not provide sufficient tension or resiliency and it is desirable to supplement its outwardly expanding action. The full enclosure of the metal spring 18 assures the sanitary nature of the construction.

Figure 1:
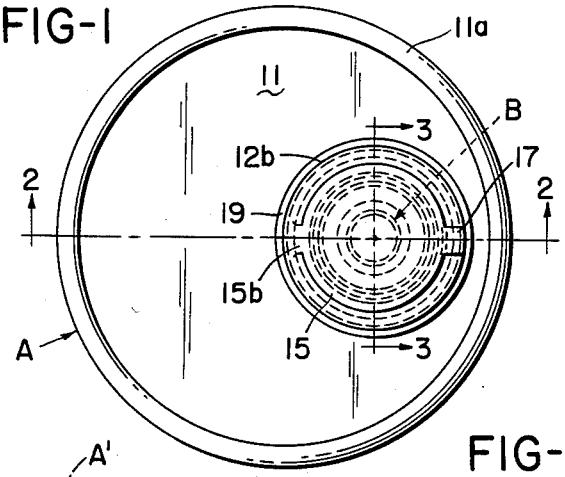
FIG. 1 is a top plan view of a can embodying a lid-spout construction of the invention.
Figure 7:
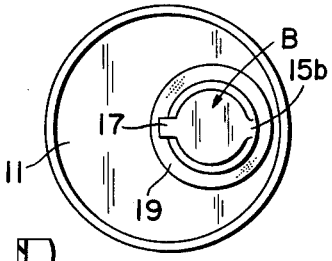
FIG. 7 is a reduced top plan view of both the constructions of FIGS. 1 and 5 with the lid-spout unit mounted on the end wall of the can in a reverse position with respect to the position shown in FIG. 1.

FIGS. 1 and 7 illustrate the fact that the unit B can be mounted in a relation, such as shown in FIGS. 1 and 4, wherein, the lid 15 of the unit has its hinge portion **15*b* facing the main body or extent of the top end wall 11 of the can, or as shown in FIG. 7, the hinge portion may be located adjacent the outer edge of the can lid 11, with the lift tab 17 facing towards the major area of its top end wall 11. This shows the versatility of the lid spout unit B which can have any suitable circumferential positioning within a preferred circular hole 11*b* in the top of the can A, since the unit B will be of a corresponding shape to fit therein. It will be noted that since the edge 11*b*** of the pour opening is circular and the outer periphery of the body part of the unit B is circular, the factor installer may initially select the exact desired position of the body part and then seal and secure the body part by inserting it into the opening at such a position.

FIG. 8, pull or lift tab **17*a* of the lid is shown extending in a sealed-off relation through the cover sheet 19. This facilitates an initial fracture of the sheet 19** and its removal when the contents of the can are to be enjoyed.

I claim:

1. A lip spout unit for sanitary mounting in a sealing-off relation about edges of and within a pour opening in a top end wall of a container, such as a beverage can which comprises, a unitary body mounted in a sealed-off relation within the pour opening; said body having an outer peripheral mounting part, a centrally disposed open-end spout, an intermediate connecting portion between said mounting part and said spout, and a spout closing-off lid; said lid being hingedly mounted on said body to open and close off said open-end spout, said spout being of bellows-like construction biased to move outwardly with respect to the top end wall of the container when said lid is in an outwardly open position, said lid being adapted to swing between open and closed positions with respect to said mounting part, said lid when closed with respect to said mounting part being adapted to abut against outer edges of said spout part and compress it within confines of said outer peripheral part and thereby close-off said spout part, and cooperating means carried by said lid and said outer peripheral part for retaining said lid in its closed position.

2. A lid spout unit as defined in claim 1 wherein said lid and said mounting part have cooperating sealing portions that are in engagement when said lid is in its closed position.

3. A lid spout unit as defined in claim 2 wherein said cooperating sealing portions are continuous tongue and groove portions.

4. A lid spout unit as defined in claim 1 wherein said lid has a hinged connection to said mounting part and also has a lift tab in a substantially opposed relation with respect to said hinged connection.

5. A lid spout construction as defined in claim 4 wherein, a thin plastic tear-off sheet is secured in a sealed relation fully over the unit as defined and to adjacent portions of the top end wall of the container, and said lift tab extends in a sealed-off relation through said sheet to facilitate removal of the sheet by an ultimate consumer.

6. A lid spout unit as defined in claim 1 wherein, a thin plastic tear-off sheet is secured in a sealed relation fully over said body and to adjacent upper surface portions of the top end wall of the container to define an initial tamperproof seal for the unit.

7. A lid spout unit as defined in claim 1 wherein said spout is of flexible convoluted construction and has a normal outward extending characteristic.

8. A lid spout unit as defined in claim 7 wherein a metal spring is imbedded in and extends along convolutions of said spout for normally urging the convolutions into a expanded relation with respect to each other.

9. A lid spout unit as defined in claim 1 wherein, said body is of a unitary construction and is of a resilient-like material, said lid has a substantially planar under surface portion that is adapted to provide a closing-off seal with outer open edges of said open-end spout to compress said spout into confines of the container when said lid is moved to its closed position, and said planar underside of said lid is adapted to provide a fluid closing seal with the outer edges of said open-end spout.

10. A lid spout unit as defined in claim 1 wherein, said body is of resilient construction, and said lid has a hinge defined by a unitary flexible connecting portion between said lid and an adjacent portion of said mounting part.

11. A lid spout unit as defined in claim 10 wherein, said cooperating means constitutes cooperating latching means between said lid and said mounting part to retain said lid in a closed, spout sealing-off position.

12. A lid spout unit for factory mounting in a sealing-off relation about edges of an within a substantially circular pour opening in a top end wall of a container such as a beverage can which comprises, a unitary resilient body construction having an outer mounting part, a centrally disposed outwardly expansible open-end spout part, and an intermediate connecting portion between said outer part and an inner open end of said spout; said spout being of bellows-like construction biased to normally expand outwardly beyond the top end wall of the container and capable of being compressed to an inside-folded position within the pour opening of the container, a resilient lid having hinge means swingably mounting it on said outer mounting part for swinging movement from a closing-off and inwardly compressing and sealing-off position with respect to said spout to a fully open position in which said spout part expands to an outer pouring position with respect to said mounting part.

13. A lid spout unit as defined in claim 12 wherein, said hinge means is a backwardly extending portion of said lid integrally connected to an upper portion of said outer mounting part, and means is carried by said outer mounting part and said lid for latching said lid in its closing-off and inwardly compressing position with respect to said spout.

14. A lid spout unit as defined in claim 12 wherein, said mounting part of said body has a circular outer peripheral portion adapted to be initially rotatably adjusted into a selected mounting position with respect to the edges of the pour opening, and means for retaining said body in a sealed relation at the selected mounting position.

15. A lid spout unit as defined in claim 12 wherein, said outer mounting part has a bifurcated edge construction that is adapted to fit in a sealed-off relation within the pouring opening and about edges of the pour opening in the top end wall, said outer mounting part also having an upwardly open continuously extending bifurcated portion thereon defining a continuous sealing groove portion, and a continuous sealing tongue projects from an underside of said lid and is adapted to seat in a sealing-off relation within said groove portion.

16. A lid spout unit as defined in claim 13 wherein said lid has a lift tab portion projecting therefrom in a substantially opposite relation with respect to said hinge means.

17. A lid spout unit as defined in claim 15 wherein, said outer mounting part has a upwardly projecting resilient hook portion, said lid has an inwardly projecting resilient hook portion that is adapted to latch-engage with said first-mentioned hook portion to retain said lid in a closing-off sealed relation with respect to said outer mounting part.

* * * * *